US008136327B1

(12) United States Patent
Sokol et al.

(10) Patent No.: US 8,136,327 B1
(45) Date of Patent: Mar. 20, 2012

(54) DOOR ADAPTED FOR AUTOMATED ASSEMBLY

(75) Inventors: Gary S. Sokol, Walkerton, IN (US); Jeffrey L. Grafrix, South Bend, IN (US)

(73) Assignee: Plyco Corp., Plymouth, WI (US)

( * ) Notice: Subject to any disclaimer, the term of this patent is extended or adjusted under 35 U.S.C. 154(b) by 43 days.

(21) Appl. No.: 12/818,917

(22) Filed: Jun. 18, 2010

(51) Int. Cl.
*E04C 2/54* (2006.01)

(52) U.S. Cl. ..... 52/784.1; 52/656.1; 52/455

(58) Field of Classification Search .... 52/784.1–784.16, 52/656.1–656.16, 455, 800.1, 802.1
See application file for complete search history.

(56) References Cited

U.S. PATENT DOCUMENTS 3,334,464 A * 8/1967 Charles ..... 52/784.15
5,577,363 A * 11/1996 Tate et al. ..... 52/784.15
5,839,252 A * 11/1998 Berghorn et al. ..... 52/784.13
2003/0140587 A1* 7/2003 Smith et al. ..... 52/455
2011/0131921 A1* 6/2011 Chen ..... 52/784.1
* cited by examiner

*Primary Examiner* — Brian Glessner
*Assistant Examiner* — Paola Agudelo
(74) *Attorney, Agent, or Firm* — Donald J. Ersler

(57) ABSTRACT

A door adapted for automated assembly includes a door frame, a first door sheet and a second door sheet. The door frame preferably includes a hinge rail, a strike rail, a top rail, a bottom rail and four corner keys. The hinge rail preferably includes a pair of snap slots formed on opposing sides. The strike rail preferably includes a pair of hook slots formed adjacent opposing sides. The door frame is assembled by inserting corner keys into ends of the hinge rail, strike rail, top rail and bottom rail. Each door sheet includes a J-shaped end formed on one end and a hook end formed on the other end thereof. The hook end is inserted into one of the hook slots and the J-shaped end is pushed into one of the snap slots. The door may then be filled with a foam material.

14 Claims, 8 Drawing Sheets

DOOR ADAPTED FOR AUTOMATED ASSEMBLY

BACKGROUND OF THE INVENTION

1. Field of the Invention

The present invention relates generally to doors and more specifically to a door adapted for automated assembly, which allows the door to be assembled more efficiently.

2. Discussion of the Prior Art

It appears that the prior art does not disclose a door having two outer sheets, where one end of each outer sheet is snapped into a hinge rail of a door frame.

Accordingly, there is a clearly felt need in the art for a door adapted for automated assembly, which includes two outer sheets that are snapped into a hinge rail and that provides more efficient assembly of a door.

SUMMARY OF THE INVENTION

The present invention provides a door adapted for automated assembly allows a door to be assembled more efficiently. The door adapted for automated assembly (door) preferably includes a door frame, a first door sheet and a second door sheet. The door frame includes a hinge rail, a strike rail, a top rail, a bottom rail and four corner keys. Each corner key includes a horizontal insertion plate, a vertical insertion plate and a gusset plate. The vertical insertion plate extends upward from an end of the horizontal insertion plate. The gusset plate extends from a top of the horizontal plate and a rear of the vertical insertion plate.

The hinge rail preferably includes a pair of snap slots formed on opposing sides and a pair of inward facing key slots. The pair of inward facing key slots are sized to firmly receive the vertical insertion plate. The strike rail preferably includes a pair of hook slots formed adjacent opposing sides and a pair of inward facing key slots. However, the pair of snap slots may also be formed in the strike rail instead of the hinge hail or the pair of snap slots may be formed in both the hinge rail and the strike rail. The pair of inward facing key slots are sized to firmly receive the vertical insertion plate. The top and bottom rails each include a pair of inward facing key slots to firmly receive the horizontal insertion plate. The door frame is assembled, before attachment of the first and second door sheets thereto.

Each door sheet preferably includes a J-shaped end formed on one end and a hook end formed on the other end thereof. However, the J-shaped end may be formed on both ends of each door sheet. A top flange extends from a top of each door sheet and a bottom flange extends from a bottom of each door sheet. A distance between inner surfaces of the top and bottom flanges is sized to receive a height of the assembled door frame. The hook end of each door sheets is inserted into one of the hook slots and the J-shaped end is pushed into one of the snap slots. The door may then be filled with a foam material, preferably through an opening in the bottom rail.

Accordingly, it is an object of the present invention to provide a door adapted for automated assembly, which includes two outer sheets that are snapped into a hinge rail.

Finally, it is another object of the present invention to provide a door adapted for automated assembly, which provides more efficient assembly of a door.

These and additional objects, advantages, features and benefits of the present invention will become apparent from the following specification.

DETAILED DESCRIPTION OF THE PREFERRED EMBODIMENTS

Figure 1:
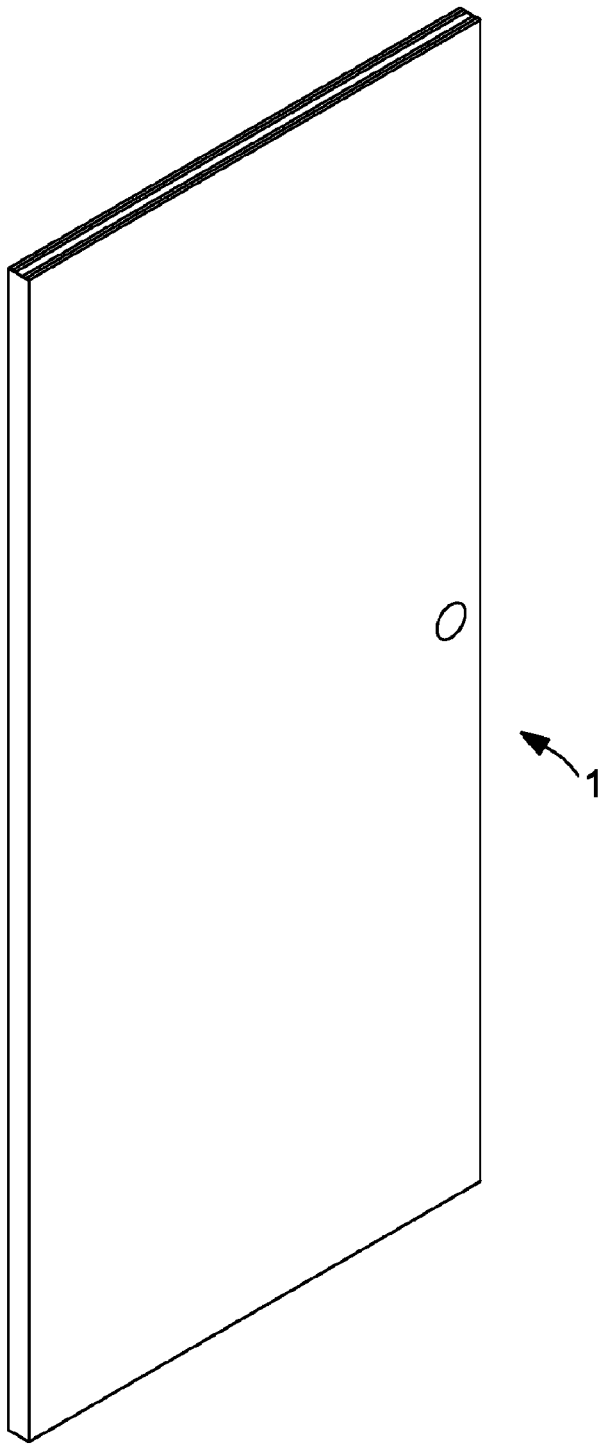
FIG. 1 is a perspective view of a door adapted for automated assembly in accordance with the present invention.
Figure 2:
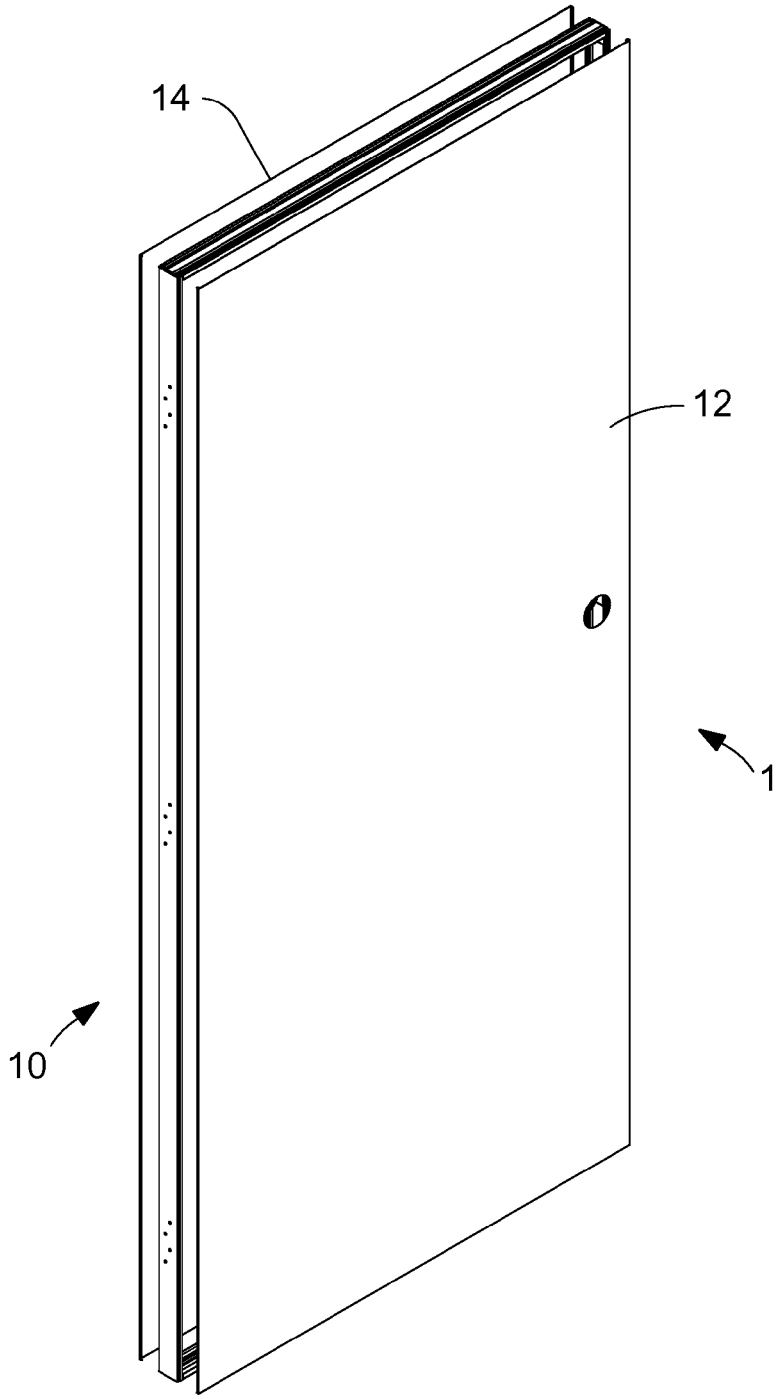
FIG. 2 is a partially exploded perspective view of a door adapted for automated assembly in accordance with the present invention.
Figure 3:
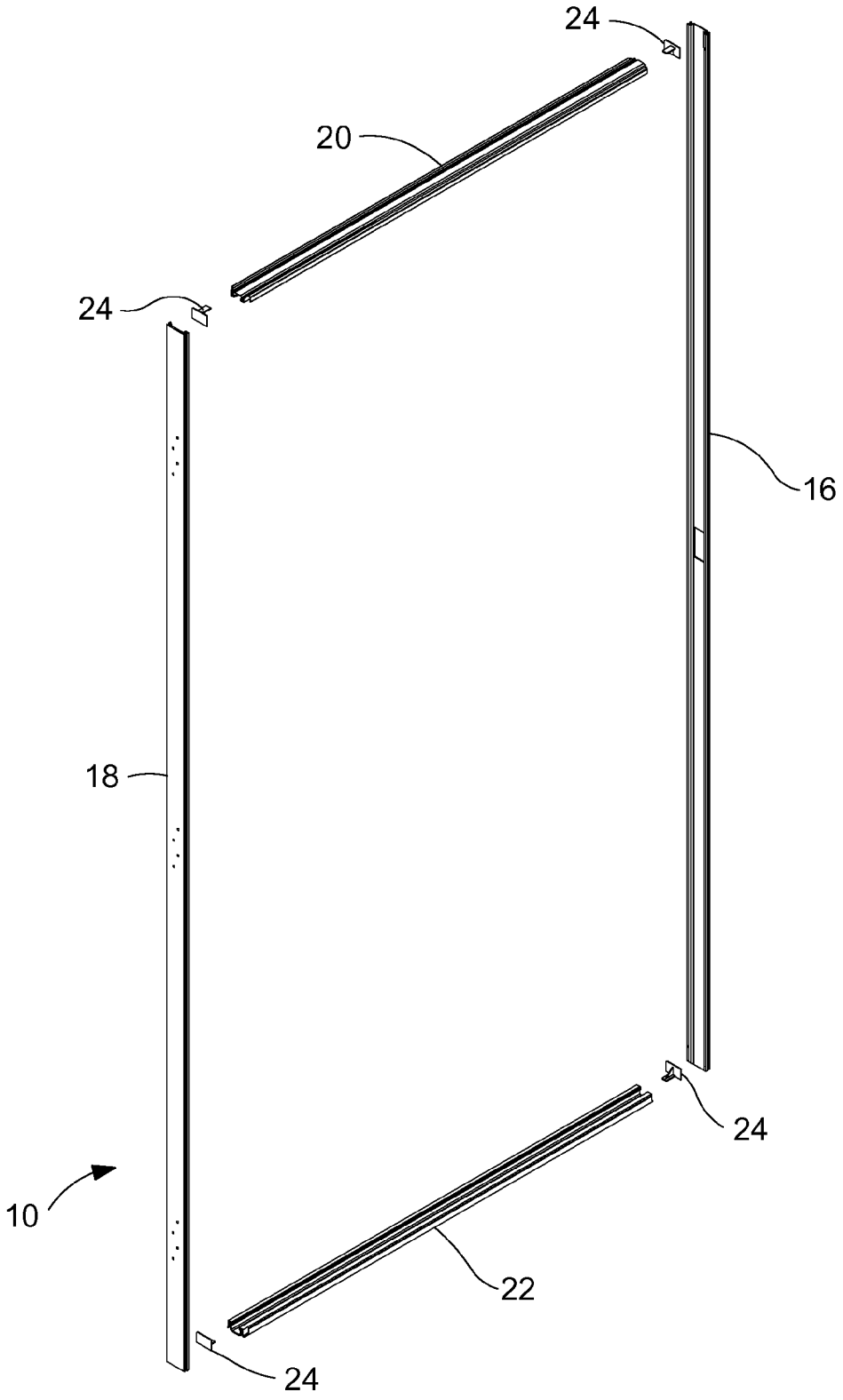
FIG. 3 is an exploded perspective view of a door frame of a door adapted for automated assembly in accordance with the present invention.
Figure 4:
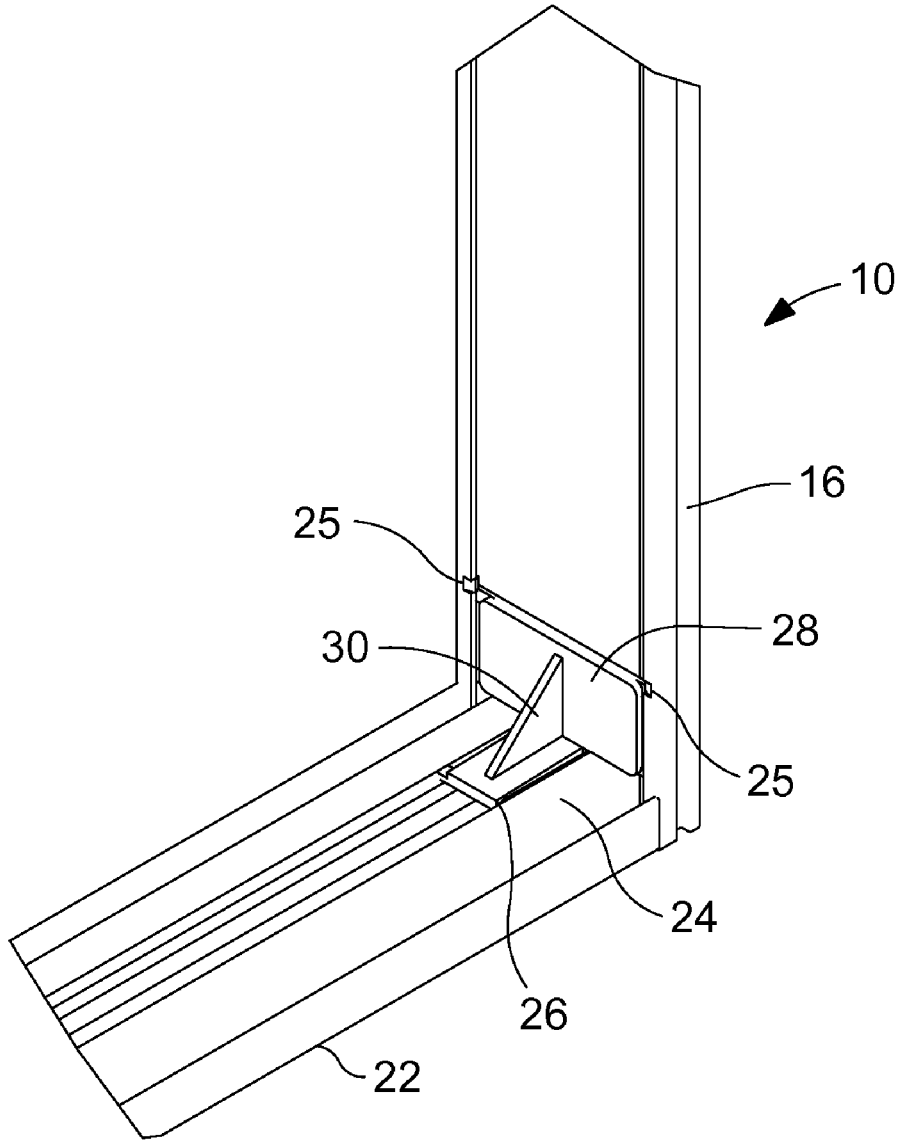
FIG. 4 is an inside perspective view of a hinge rail attached to a bottom rail of a door frame of a door adapted for automated assembly in accordance with the present invention.
Figure 9:
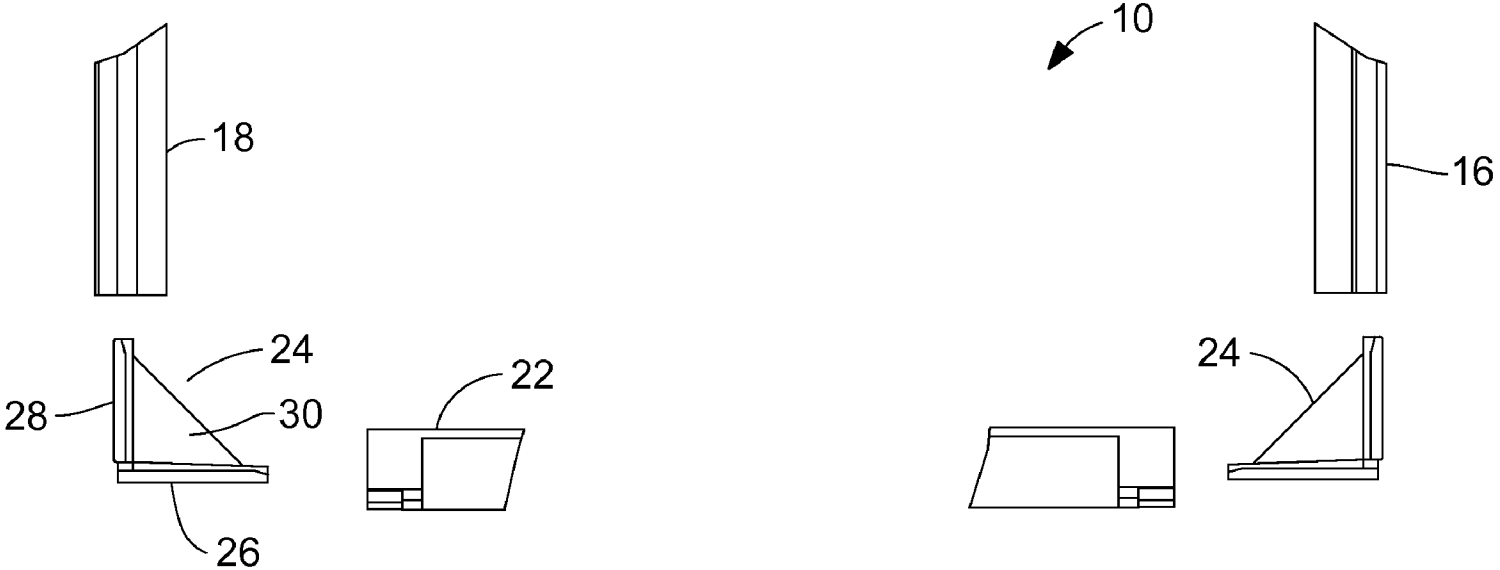
FIG. 9 is an exploded front view of a bottom portion of a door frame of a door adapted for automated assembly in accordance with the present invention.

With reference now to the drawings, and particularly to FIG. 1, there is shown a perspective view of a door adapted for automated assembly 1. With reference to FIGS. 2-3, the door adapted for automated assembly 1 includes a door frame 10, a first door sheet 12 and a second door sheet 14. The door frame 10 preferably includes a hinge rail 16, a strike rail 18, a top rail 20, a bottom rail 22 and four corner keys 24. With reference to FIGS. 4 and 9, each corner key 24 includes a horizontal insertion plate 26, a vertical insertion plate 28 and a gusset plate 30. The corner key 24 is preferably fabricated by plastic injection molding, but other materials and manufacturing methods may also be used. The vertical insertion plate 28 extends upward from an end of the horizontal insertion plate 26. The gusset plate 30 extends from a top of the horizontal insertion plate 26 and a rear of the vertical insertion plate 28. The gusset plate 30 ensures that the vertical and horizontal insertion plates are kept substantially perpendicular to each other. An offset projection 25 is formed in substantially each end of the hinge rail 16 and the strike rail 18 to limit the sliding travel of the vertical plate 28 relative to the hinge and strike rails.

Figure 5:
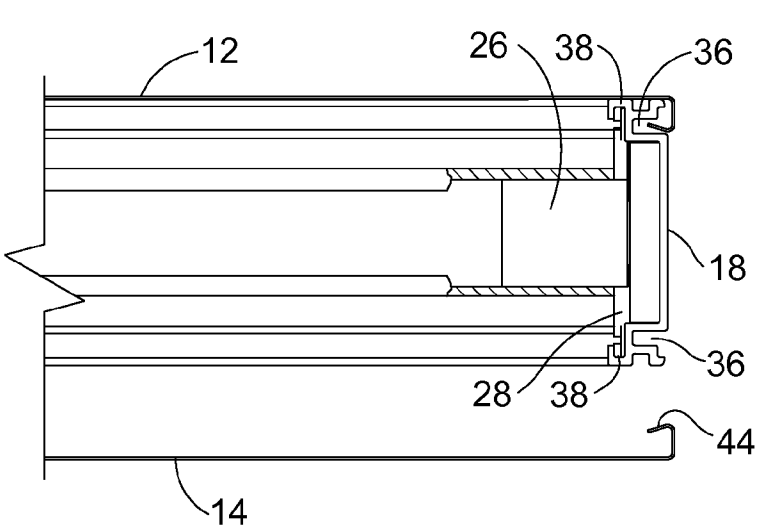
FIG. 5 is a top end view of a door adapted for automated assembly in accordance with the present invention.
Figure 5:
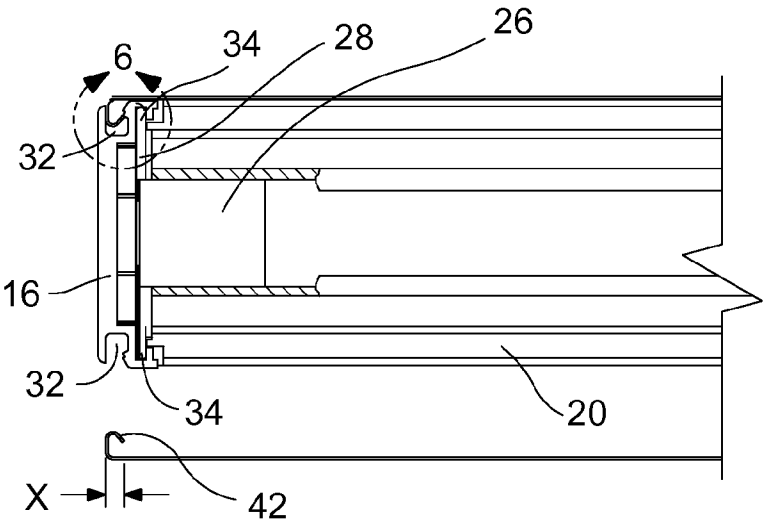
Figure 6:
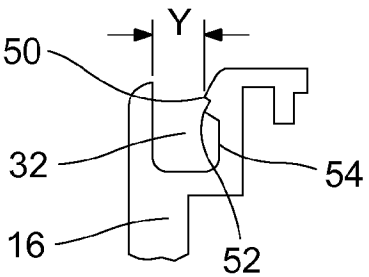
FIG. 6 is an enlarged end view of a snap slot of a hinge rail of a door adapted for automated assembly in accordance with the present invention.

With reference to FIGS. 5-6, the hinge rail 16 preferably includes a pair of snap slots 32 formed on opposing sides and a pair of inward facing key slots 34. The pair of inward facing key slots 34 are sized to firmly receive the vertical insertion plate 28. The hinge rail 16 is preferably an aluminum extrusion, but other materials may also be used. The strike rail 18 preferably includes a pair of hook slots 36 formed adjacent opposing sides and a pair of inward facing key slots 38. The pair of inward facing key slots 38 are sized to firmly receive the vertical insertion plate 28. The strike rail 18 is preferably an aluminum extrusion, but other materials may also be used. However, the pair of snap slots 32 may also be formed in the strike rail 18 instead of the hinge hail 16 or the pair of snap slots 32 may be formed in both the hinge rail 16 and the strike rail 18.

Figure 7:
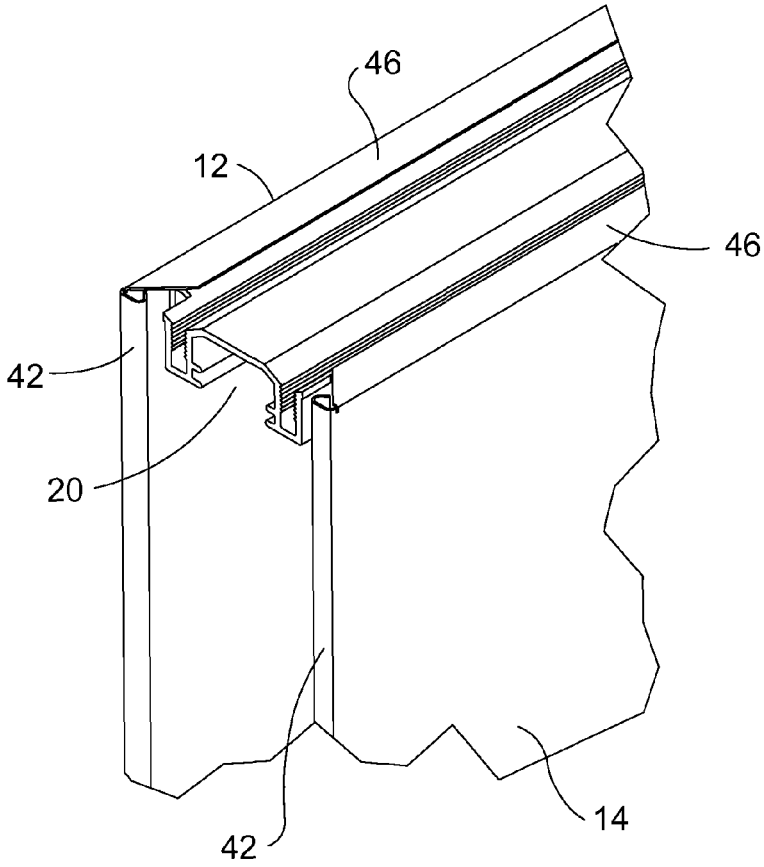
FIG. 7 is a top perspective view of a top rail retained between first and second door sheets of a door adapted for automated assembly in accordance with the present invention.
Figure 8:
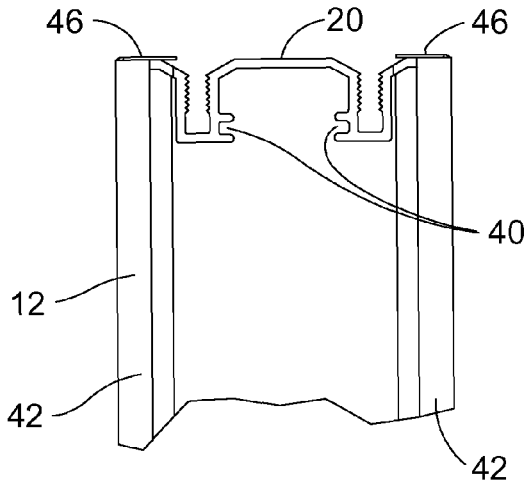
FIG. 8 is an end view of a top rail retained between first and second door sheets of a door adapted for automated assembly in accordance with the present invention.

With reference to FIGS. 7-8, the top rail 20 and the bottom rail 22 each include a pair of inward facing key slots 40 to firmly receive the horizontal insertion plate 26. The bottom rail 22 is the same as the top rail 20 with the exception of a preferable opening formed through the bottom rail 22 to fill an inner cavity of the door adapted for automated assembly 1 with a foam material. The top and bottom rails are preferably an aluminum extrusion, but other materials may also be used. The door frame 10 is assembled, before attachment of the first and second doors sheets thereto.

Figure 10:
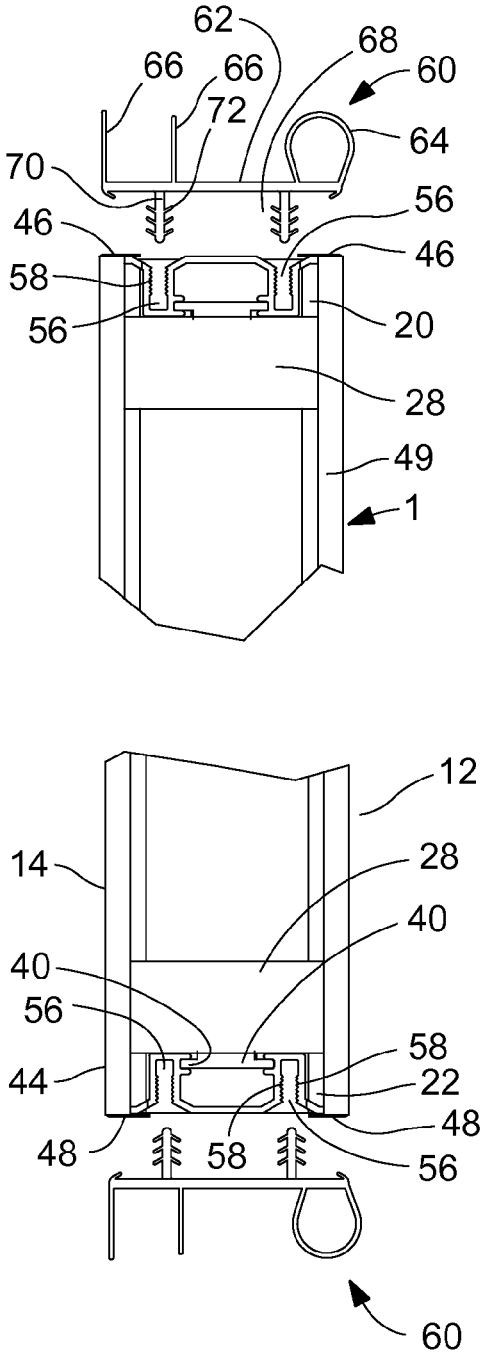
FIG. 10 is a partially exploded end view of a door adapted for automated assembly with the hinge or strike plate removed in accordance with the present invention.
Figure 11:
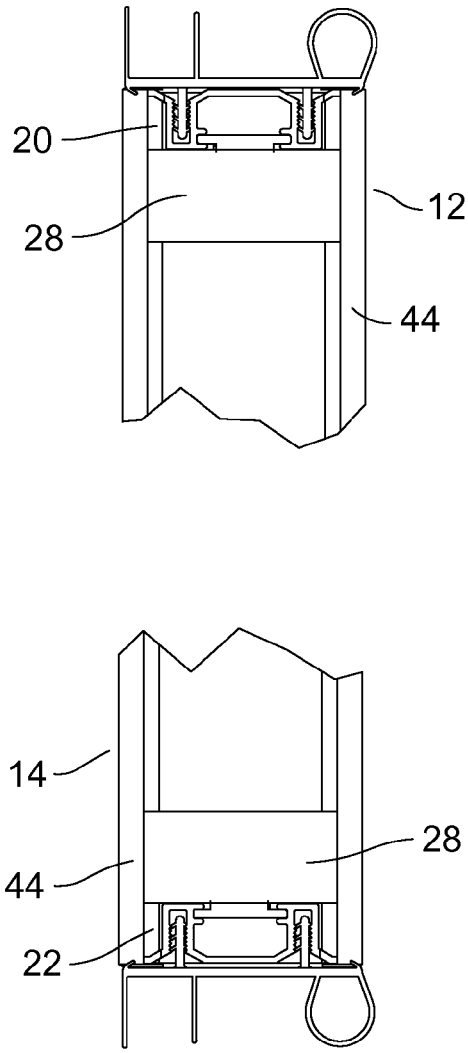
FIG. 11 is an end view of a door adapted for automated assembly with the hinge or strike plate removed in accordance with the present invention.

With reference to FIG. 5, each door sheet 12, 14 includes a J-shaped end 42 formed on one end and a hook end 44 formed on the other end thereof. However, the J-shaped end 42 may be formed on both ends of each door sheet 12, 14. With reference to FIGS. 10-11, a top flange 46 extends from a top of the door sheet 12, 14 and a bottom flange 48 extends from a bottom of the door sheet 12, 14. A distance between inner surfaces of the top and bottom flanges is sized to receive a height of the door frame 10. The hook end 44 is inserted into one of the hook slots 36 and the J-shaped end 42 is pushed into one of the snap slots 32.

With reference to FIG. 6, each snap slot 32 includes at least one retention projection. A first retention projection 50 extends outward from the snap slot 32, near an entrance of the snap slot 32. A second retention projection 52 is located below the first projection 50. An undercut relief 54 is located under the second retention projection 52 to provide clearance for the J-shaped end 42. The second retention projection 52 and the undercut relief 54 retain the J-shaped end 42 in the snap slot 32. The J-shaped end 42 must be compressed for insertion past the first and second projections, where dimension X>dimension Y.

With reference to FIGS. 10-11, the top rail 20 includes two projection retention slots 56. The bottom rail 22 includes two projection retention slots 56. Each projection slot 56 includes a plurality of teeth 58 formed on opposing walls thereof. A panel seal 60 includes a sealing base 62, a sealing tube 64, at least one sealing flap 66 and at least one retention projection 68. The sealing tube 64 extends from one end and one side of the sealing base 62 and the at least one sealing flap extends from the other end and the one side of the sealing base 62. The at least one retention projection 68 extends from the other side of the sealing base 62. Each retention projection 68 includes a projection base 70 and a plurality of retention flaps 72 extending from each side of the projection base 70. The plurality of retention flaps 72 engage the plurality of teeth 58 in the projection slot 56. The door 1 may be filled with a styrofoam material preferably through an opening (not shown) in the bottom rail 22.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A door adapted for automated assembly, comprising:

a door frame includes a hinge rail, a strike rail, a top rail, a bottom rail, said strike rail includes a pair of snap slots formed on opposing sides thereof, said hinge rail includes a pair of hook slots formed adjacent opposing sides thereof, one end of said hinge rail is secured to one end of said top rail, one end of said strike rail is secured to the other end of said top rail, the other end of said hinge rail is secured to one end of said bottom rail, the other end of said strike rail is secured to the other end of said bottom rail;

a first door sheet includes a first J-shaped end formed on one end and a first hook end formed on the other end thereof; and a second door sheet includes a second J-shaped end formed on one end and a second hook end formed on the other end thereof, said first hook end is inserted into one of said pair of hook slots, said first J-shaped end is pushed into one of said pair of snap slots, said second hook end is inserted into the other one of said pair of hook slots, said second J-shaped end is pushed into the other one of said pair of snap slots, each one of said pair of snap slots includes a snap opening, and each one of said pair of hook slots includes a hook opening, wherein each one of said pair of snap openings is oriented substantially perpendicularly with respect to each one of said pair of hook openings.

2. The door adapted for automated assembly of claim 1, further comprising:

four corner keys, each one of said four corner keys includes a horizontal insertion plate, a vertical insertion plate and a gusset plate, said vertical insertion plate extends upward from an end of said horizontal insertion plate, said gusset plate extends from a top of said horizontal plate and a rear of said vertical insertion plate, said four corner keys are used to secure said hinge rail, said strike rail, said top rail and said bottom rail to each other.

3. The door adapted for automated assembly of claim 1, further comprising:

a first top flange is formed on a top of said first door sheet, a first bottom flange is formed on a bottom of said first door sheet, a distance between an inner surface of said first bottom flange and said first top flange is sized to receive a height of said door frame.

4. The door adapted for automated assembly of claim 1, further comprising:

a second top flange is formed on a top of said second door sheet, a second bottom flange is formed on a bottom of said second door sheet, a distance between an inner surface of said second bottom flange and said second top flange is sized to receive a height of said door frame.

5. The door adapted for automated assembly of claim 1 wherein:

an hinge offset projection is formed in substantially each end of said hinge rail, a strike offset projection is formed in substantially each end of said strike rail.

6. The door adapted for automated assembly of claim 1 wherein:

said door adapted for automated assembly is filled with a foam material after the attachment of said first and second door sheets.

7. The door adapted for automated assembly of claim 1 wherein:

a top seal panel is secured to said top rail, a bottom seal panel is secured to said bottom rail.

8. A door adapted for automated assembly, comprising:

a door frame includes a first rail, a second rail, a top rail, a bottom rail, one of said first and second rails includes a pair of snap slots formed on opposing sides thereof, the other one of said first and second rails includes a pair of hook slots formed adjacent opposing sides thereof, one end of said first rail is secured to one end of said top rail, one end of said second rail is secured to the other end of said top rail, the other end of said first rail is secured to one end of said bottom rail, the other end of said second rail is secured to the other end of said bottom rail;

a first door sheet includes a first J-shaped end formed on one end and a first hook end formed on the other end thereof; and a second door sheet includes a second J-shaped end formed on one end and a second hook end formed on the other end thereof, said first hook end is inserted into one of said pair of hook slots, said first J-shaped end is pushed into one of said pair of snap slots, said second hook end is inserted into the other one of said pair of hook slots, said second J-shaped end is pushed into the other one of said pair of snap slots, each one of said pair of hook slots includes a hook opening, each one of said pair of snap slots includes a snap opening, wherein each one of said pair of snap openings is oriented substantially perpendicularly with respect to each one of said pair of hook openings.

9. The door adapted for automated assembly of claim 8, further comprising:

four corner keys, each one of said four corner keys includes a horizontal insertion plate, a vertical insertion plate and a gusset plate, said vertical insertion plate extends upward from an end of said horizontal insertion plate, said gusset plate extends from a top of said horizontal plate and a rear of said vertical insertion plate, said four corner keys are used to secure said first rail, said second rail, said top rail and said bottom rail to each other.

10. The door adapted for automated assembly of claim 8, further comprising:

a first top flange is formed on a top of said first door sheet, a first bottom flange is formed on a bottom of said first door sheet, a distance between an inner surface of said first bottom flange and said first top flange is sized to receive a height of said door frame.

11. The door adapted for automated assembly of claim 8, further comprising:

a second top flange is formed on a top of said second door sheet, a second bottom flange is formed on a bottom of said second door sheet, a distance between an inner surface of said second bottom flange and said second top flange is sized to receive a height of said door frame.

12. The door adapted for automated assembly of claim 8 wherein:

a first rail offset projection is formed in substantially each end of said first rail, a second rail offset projection is formed in substantially each end of said second rail.

13. The door adapted for automated assembly of claim 8 wherein:

at least one retention projection extends from a wall of each one of said pair of snap slots.

14. The door adapted for automated assembly of claim 13 wherein:

said first J-shaped end is pushed into one of said pair of snap slots and past said at least one retention projection thereof, said first J-shaped end is compressed during insertion.

* * * * *